US005135158A

United States Patent [19]

Boyle et al.

[11] Patent Number: 5,135,158

[45] Date of Patent: Aug. 4, 1992

[54] THREE-CELL, RECLOSABLE PRODUCT DISPENSER

[75] Inventors: Daniel J. Boyle, Hartland, Wis.; Herbert L. Lambert, West Chicago, Ill.

[73] Assignee: Waldorf Corporation, St. Paul, Minn.

[21] Appl. No.: 661,422

[22] Filed: Feb. 26, 1991

[51] Int. Cl.[5] ..... B65D 5/70

[52] U.S. Cl. ..... 229/102; 229/120.03; 229/229; 229/232

[58] Field of Search ..... 229/102, 120.03, 120.18, 229/131.1, 155, 229, 232; 206/611, 626, 807

[56] References Cited

U.S. PATENT DOCUMENTS

| | | | |
|---|---|---|---|
| 970,220 | 9/1910 | Handschy . | |
| 1,014,081 | 1/1912 | Miller . | |
| 1,108,006 | 8/1914 | Rey | 229/120.03 X |
| 1,112,752 | 10/1914 | Avellanal | 229/120.18 X |
| 1,157,712 | 10/1915 | Miller . | |
| 2,002,485 | 5/1935 | Alfred . | |
| 2,015,278 | 9/1935 | Meyer . | |
| 2,143,940 | 1/1939 | Craig et al. | 229/131.1 X |
| 2,360,415 | 10/1944 | Gilbert | 229/229 X |
| 2,473,492 | 6/1949 | Shina | 229/229 |
| 2,983,421 | 5/1961 | Turpin | 206/626 |
| 3,115,290 | 12/1963 | Byassee . | |
| 3,155,306 | 11/1964 | Moore | 206/626 X |
| 3,157,344 | 11/1964 | Hennessey . | |
| 3,181,767 | 5/1965 | Starkey . | |
| 3,203,616 | 8/1965 | Bolton et al. | 206/626 |
| 3,266,055 | 8/1966 | Graybill | 206/807 |
| 3,533,874 | 10/1970 | Elias | 229/120.03 X |
| 4,059,201 | 11/1977 | Foster . | |
| 4,094,456 | 6/1978 | Roccaforte . | |
| 4,141,485 | 2/1979 | Lambert . | |
| 4,201,329 | 5/1980 | Roccaforte . | |
| 4,361,270 | 11/1982 | Roccaforte . | |
| 4,508,226 | 4/1985 | Davis et al. | 206/807 X |
| 4,548,318 | 10/1985 | Boyle . | |
| 4,705,197 | 11/1987 | Gorden et al. . | |
| 4,887,718 | 12/1989 | Anderson et al. | 206/626 X |
| 4,909,395 | 3/1990 | Weissmann | 229/131.1 X |
| 4,919,313 | 4/1990 | O'Brien . | |
| 4,944,406 | 7/1990 | Zehnal | 206/626 X |

FOREIGN PATENT DOCUMENTS

| | | | |
|---|---|---|---|
| 753118 | 2/1967 | Canada | 229/120.03 |
| 1232247 | 2/1988 | Canada . | |

*Primary Examiner*—Stephen Marcus
*Assistant Examiner*—Jes F. Pascua
*Attorney, Agent, or Firm*—Dorsey & Whitney

[57] ABSTRACT

The present invention is an improved reclosable dispensing carton, particularly adapted for dispensing one or more flavors or kinds of small candy items. The generally tubular carton is rectangular, having front and rear walls, opposed side walls foldably attached to the front and rear walls, a closed bottom end and a reclosable top dispensing end. The dispensing end comprises a plurality of top closure flaps that are in close parallel relationship when the carton is fully closed. The top closure flaps include an inside major flap having stripped out or relieved areas along its free edge and an outside major flap foldably connected to the front wall of the carton and incorporating foldably connected, manipulable lift away cover tabs adapted to overly the relieved areas when the carton is closed. The lift tabs are provided with deflectable locks for locking and relocking the carton closed after it is initially opened.

20 Claims, 8 Drawing Sheets

THREE-CELL, RECLOSABLE PRODUCT DISPENSER

TECHNICAL FIELD

The present invention relates to dispensing cartons for dispensing small individual articles of food, such as small candy pieces or the like. More particularly, the present invention relates to a reclosable dispensing carton wherein several different kinds of candy may be dispensed from the same carton through several dispensing openings that may be independently opened and lockably reclosed.

BACKGROUND OF THE INVENTION

The dispensing carton of the present inveniton is an improvement over the inventions disclosed in the U.S. Pat. No. 2,002,485, 4,361,270 and 4,548,318.

The invention disclosed in U.S. Pat. No. 4,361,270 patent is a two-cell reclosable dispensing carton with opposed sliding tabs lying between the overlapping end closure flaps. The sliding tabs are provided to open and reclose product dispensing openings in the end closure flaps.

U.S. Pat. No. 4,548,318 discloses a reclosable dispensing carton wherein the front wall of the carton has a nicked out circular portion. Ths central part of a cover flap extending from the top wall panel has a debossed circular area overlying and glued to the nicked out part of the front wall. When the central part of the cover flap is lifted, the nicked out area is removed from the front wall to form a dispensing opening. To reclose the carton, the central part of the cover flap is urged against the carton front wall, causing the nicked out area to frictionally lock within the opening created by its removal. In a multi-cell version of this carton, each cell has its own dispensing opening with the structure just described.

U.S. Pat. No. 2,002,485 shows a carton with a multi-flap top end closure with a dispensing arrangement. Adjacent relieved areas in the two innermost panels, define a dispensing opening. A first tear-out tab in the panel next overlying the two innermost panels can be torn loose and hinged away from the opening. The outmost panel also has a tear-out tab overlying the opening. This second tear-out tab can also be torn loose and hinged away from the opening. The first and second tear-out tabs rotate on their hinges in opposite directions. Rotating the tear-out tabs back into the panels from which they were torn loose effects closure of the dispensing opening.

While the above-cited prior art patents represent improvements in reclosable dispensing carton, there are some problems that are not completely addressed.

One such problem is that the opening and reclosing structures of the prior art cartons do not facilitate the use of the cartons by children. In the case of cartons with overlying and tear-out portions, it may be difficult for a child to tear multiple layers of the material from which the carton is made to gain access to the contents.

With respect to the carton disclosed in U.S. Pat. No. 2,002,485, multiple portions of the carton have to be manipulated to gain access to the contents even after initial opening. Additionally, although lockably reclosing dispensing openings are disclosed in the piror art, the reclosing and locking features may be difficult to manipulate.

With regard to U.S. Pat. No. 4,361,270, disclosing a carton with tabs that slide between closely adjacent overlying end closure flaps, the slidable tabs may become sticky or bent and a child will have difficulty manipulating the tabs in that condition. Additionally, a way to positively lock that carton closed is not disclosed.

A reclosable dispending carton for containing and dispensing one or more varieties of small food items such as candy, which is easy to open and lockably reclose, yet which may be produced efficiently and inexpensively, would be a decided improvement over the dispensing containers in the prior art.

SUMMARY OF THE INVENTION

The present invention is an improved reclosable dispensing carton, particularly adapted for dispensing one or more flavors or kinds of small candy items or the like. The carton is generally in the form of a rectangular box, having front and rear walls, opposed side walls foldably attached to the front and rear walls, a closed bottom end structure and a reclosable top dispensing end structure. The dispensing end structure comprises a plurality of top closure flaps that are in close parallel relationship when the carton is fully closed. The top closure flaps include an inside major flap having relieved or stripped out areas along its free edge and an outside major flap with foldably connected, manipulable lift cover tabs adapted to overlie the relieved areas when the carton is closed. The lift cover tabs are provided with defectable lock tabs for locking or relocking the carton to close it after it is initially opened.

To form the carton into its point of sale and use configuration, it is first formed as a tube with a generally rectangular cross-section. To close the top, the major inside flap is folded or rotated inwardly to become the innermost top closure flap. Next, the two minor end closure flaps are folded inwardly toward one another to overlie the inside major flap. The minor flaps include stripped out areas that closely correspond to the relieved or stripped out portions of the inside end closure flap, thereby contributing to carton strength and integrity yet allowing access to the carton contents. The top outside major flap is folded downwardly about the top end of the carton and is secured to the rear wall.

For dispensing, a selected one or a number of the cover tabs may be rotated away from the top end of the carton by tearing them loose from the top outside major flap at all edges save their hinge edge, thus exposing the relieved areas and any access tabs of the inside closure flap, whereby the product contained in the package may be dispensed through the openings provided by the relieved areas or the removable access tabs. For reclosing, the cover tabs simply are urged against the inside major flap sufficiently to cause the defectable lock to engage an edge of an opening in the inside flap.

The invention encompasses both an embodiment wherein the relieved areas themselves are large enough to provide product access and an embodiment with limited relieved areas and removable access tabs adjacent the relieved areas for providing additional tamper evidence. A flat blank that may be folded and locked into the preceding package configurations is also encompassed. The blank may be made from paperboard or other suitable material.

An object of the present invention is to provide a locking, reclosable dispensing carton that facilitates the use of the carbon by children.

Another object of the present invention is to provide a lockably reclosable dispensing carton that is easy to open and reclose, yet protects the product contained therein and provides resistance to tampering and evidence of tampering.

Yet another object of the present invention is to provide a multi-cell, reclosable dispensing carton that may be locked closed after the initial opening and yet may be manufactured, glued and erected efficiently, resulting in a less expensive carton.

Other objects and advantages of the present invention will become more fully apparent and understood with reference to the following specification and to the appended drawings and claims.

DETAILED DESCRIPTION OF THE PREFERRED EMBODIMENTS

Figure 13:
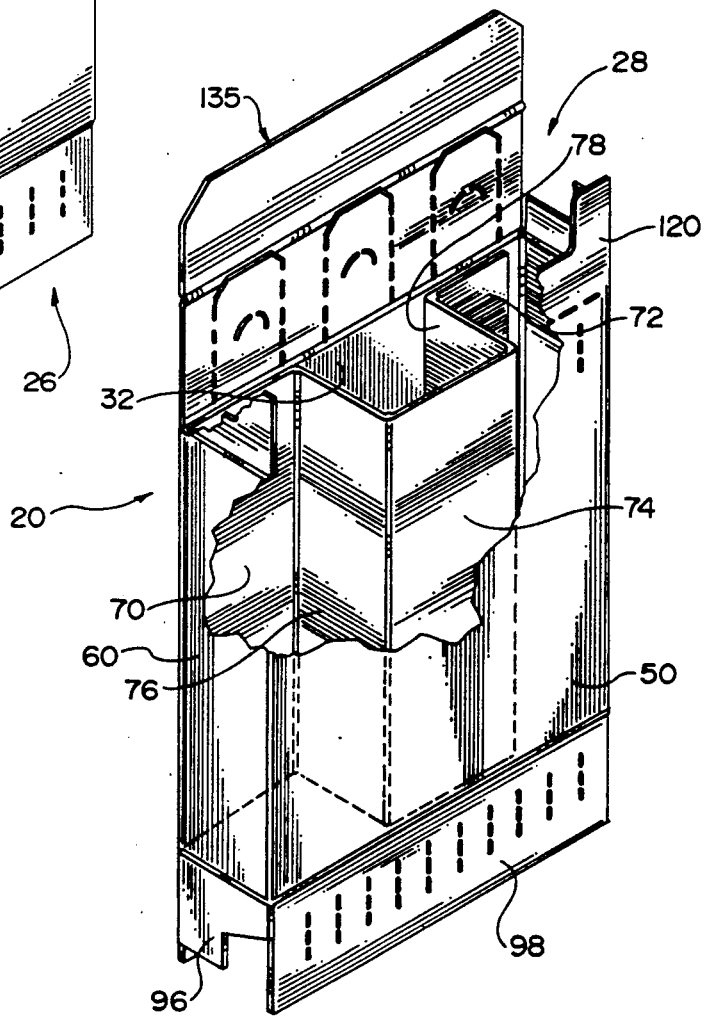
FIG. 13 is a perspective view of the carton of the present invention as in FIG. 6, with parts cut away to show the internal cell structure.
Figure 8:
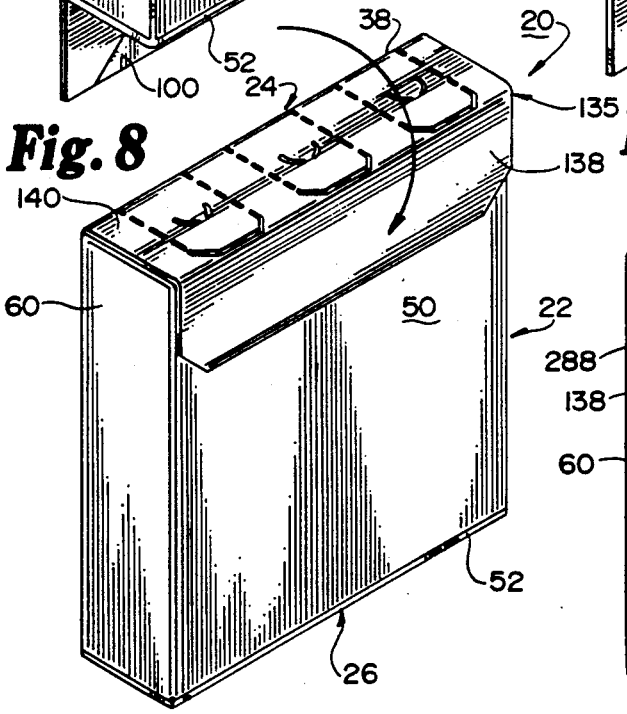
FIG. 8 is a perspective view of the carton erected and sealed.

As best seen in FIG. 8, a completed carton 20 in accordance with the present invention has a tubular outer shell or body 22 with a rectangular cross-section, a top end structure 24, and a bottom end structure 26. It also has an interior multiple cell structure 28 (as best seen in FIG. 13).

Figure 1:
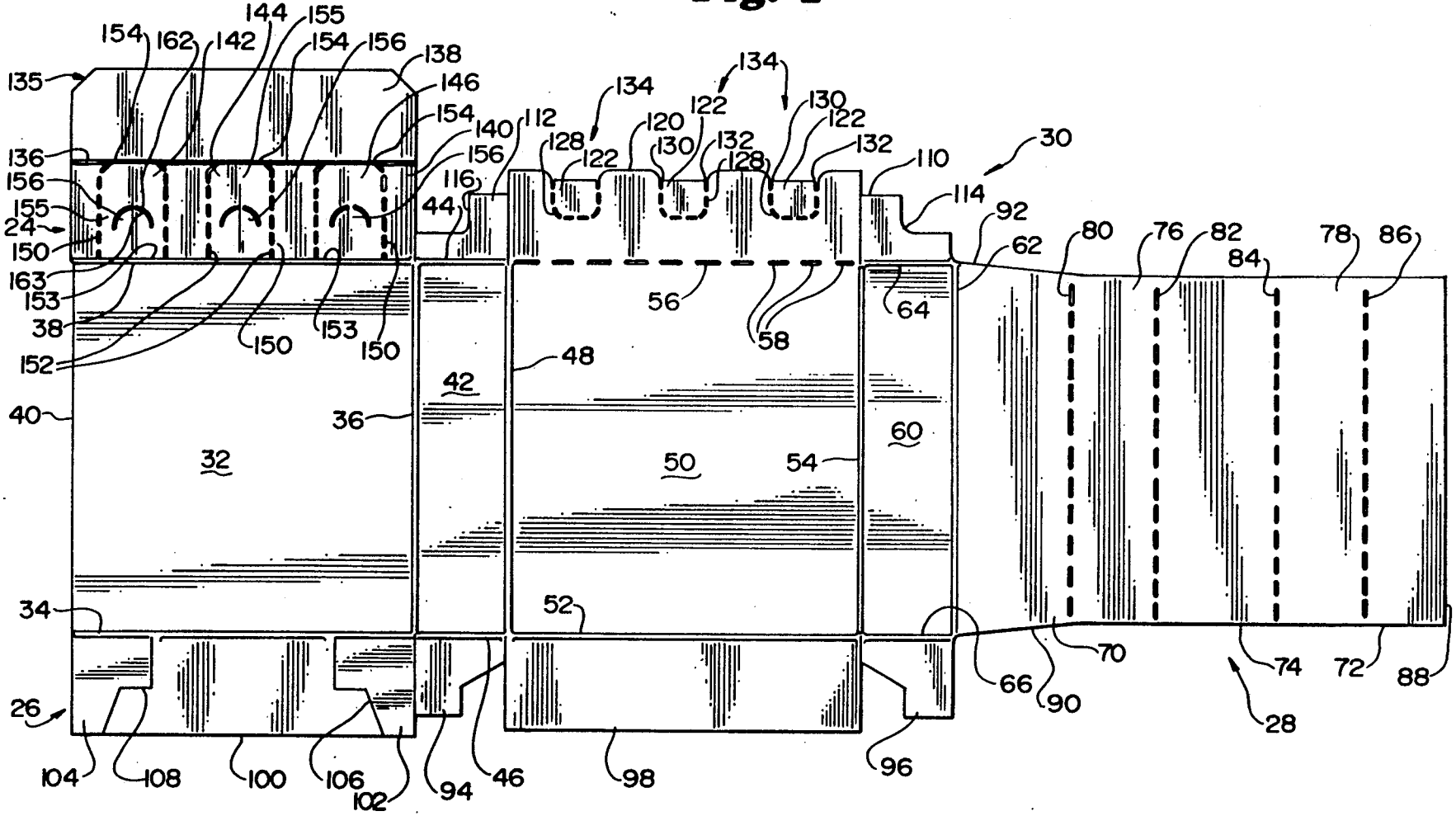
FIG. 1 a is top plan view of the inside surface of the blank from which the carton of the present invention may be formed and shows the die cut profile thereof.

FIG. 1 depicts the inside surface of a blank 30 for forming, in accordance with the present invention, the carton 20 depicted in FIGS. 2-11 and 13. In the drawings, double lines indicate scores used to form fold lines. Single solid lines indicate cuts or free edges, except where otherwise indicated.

The blank 30 has a generally rectangular front wall panel 32 having two opposed pairs of edges defined by fold lines 34, 36, 38 and free edge 40. A first side wall panel 42 is foldably attached to the front wall panel 32 along fold line 36. The remaining edges of the sidewall panel 42 are defined by fold lines 44, 46, and 48.

A generally rectangular rear wall panel 50 is foldably attached to the sidewall panel 42 along fold line 48. The perimeter of the rear wall panel 50 is generally congruent to the perimeter of the front wall panel 32 and is defined by fold lines 48, 52, 54, and 56. Fold line 56 is formed with a series of in-line perforations or incisions 58. A second side wall panel 60 is foldly connected to the rear wall panel 50 along fold line 54. The remaining edges of the second side wall panel 60 are defined by fold lines 62, 64 and 66.

FIG. 1 also shows the portion of blank 30 that forms the interior cell structure 28. The cell structure 28 is formed by a pair of front wall cell panels. 70, 72 and a rear wall cell panel 74, with a pair of cell side wall panels 76, 78 foldably coupled to and positioned between the front and rear wall cell panels 70, 72, 74, respectively. The front wall cell panel 70 is foldably connected to the second side wall panel 60 along fold line 62. The remaining cell wall panels 76, 74, 78, 72 forming the interior cell structure 28 are separated at and foldably connected to each other at the four perforated or cut score parallel fold lines 80, 82, 84 and 86. The section of the blank 30 defining the interior cell structure 28 terminates in a free edge 88.

The end edges 90, 92 of the front wall cell panel 70 taper inwardly away from the generally central region of the blank 30 in the direction of the edge 88. The remaining cell wall panels 76, 74, 78, 72 are generally rectangular.

FIG. 1 also depicts the portion of the blank 30 for forming the bottom end structure 26 of the carton 20 of the present invention. The blank 30 includes a pair of minor bottom closure flaps 94, 96 foldably connected to the first and second carton side wall panels 42, 60, respectively. A major inside bottom end closure flap 98 is foldably connected to the rear wall panel 50 along fold line 52. As depicted in the drawings (FIG. 6), the opposite side of the major inside bottom end closure flap 98 may be provided with a plurality of adhesive score lines 99. A major outside bottom end closure flap 100 is foldably connected to the front wall panel 32 at fold line 34. The major outside bottom end closure flap 100 has a pair of embossed seats 102, 104 (one adjacent each end) for compensating for the thickness of the minor closure flaps 94, 96 when the bottom end structure 26 of the carton 20 is in its fully closed and sealed position as depicted in FIG. 8. The embossed seats 102, 104 are defined by step score lines 106, 108.

To form the top end structure 24 of the carton 20 (depicted in FIG. 8), the blank 30 includes a pair of inside minor closure flaps 110, 112 foldably to connected the carton side wall panels 60, 42, respectively, at fold lines 64, 44, respectively. The inside minor closure flaps 110, 112 have stripped out or relieved areas 114, 116.

A major inside top end closure flap 120 in foldably connected to the carton rear wall panel 50 along a cut fold score line 56. The major inside top end clsoure flap 120 includes a plurality of continuous U-shaped lines of weakness 128, each having two ends 130, 132 adjacent the free edge of the inside flap 120 and each defining an inside access tab 122. The free edge of the inside flap 120 has a relieved area 134 between the ends 130, 132 of each line of weakness 128. Although three lines of weakness 128 and, correspondingly, three relieved areas 134 are depicted in FIG. 1, it is within the scope of the present invention that one or more such lines of weakness and relieved areas may be provided, depending upon and corresponding to the number of cells formed by the interior cell structure 28.

The blank 30 includes a major outside top end closure flap 135 foldably attached to the front wall panel 32 at and along fold line 38. The major outside top end closure flap 135 includes a fold line 136 separating the flap 135 into a gluing panel portion 138 and an opening panel portion 140. The opening panel 140 has a plurality of lift away cover tabs 142, 144, 146. Each cover tab 142, 144, 146 is formed and defined by a continuous, generally U-shaped line of weakness 150. Each line 150, which may be formed by a plurality of in-line cuts, has two ends 152 abutting fold line 38. The portion of the fold line 38 that lies between the ends 152 of the lines of weakness 150, indicated generally at 153, defines a foldable hinge operably connecting the individual cover tabs 142, 144, 146 to the front wall panel 32 at fold line 38. At the ends of the cover tabs 142, 144, 146 opposite the hinges 153, a portion of each of the lines 150 is a continuous cut or finger-edge forming incision 154 for forming a finger lip 155 for facilitating the moving of the cover tabs 142, 144, 146. The incisions 154 are generally collinear with the fold score line 136.

FIG. 1 also depicts that each cover tab 142, 144, 146 has a deflectable lock tab 156. Each lock tab 156 is generally centrally located in one of the cover tabs 142, 144, 146 and is formed by generally semi-circular cut line 162. The line 162 includes nick 163, an uncut area between the curved cuts forming the semi-circular line 162. One of the purposes for the nick 163 is to provide evidence of attempted tampering. The portion of each lock tab 156 adjacent the line 162 may be deflected from the plane of the opening panel 140, due in part to the resilient, flexible nature of the material from which the carton 20 is formed.

Figure 2:
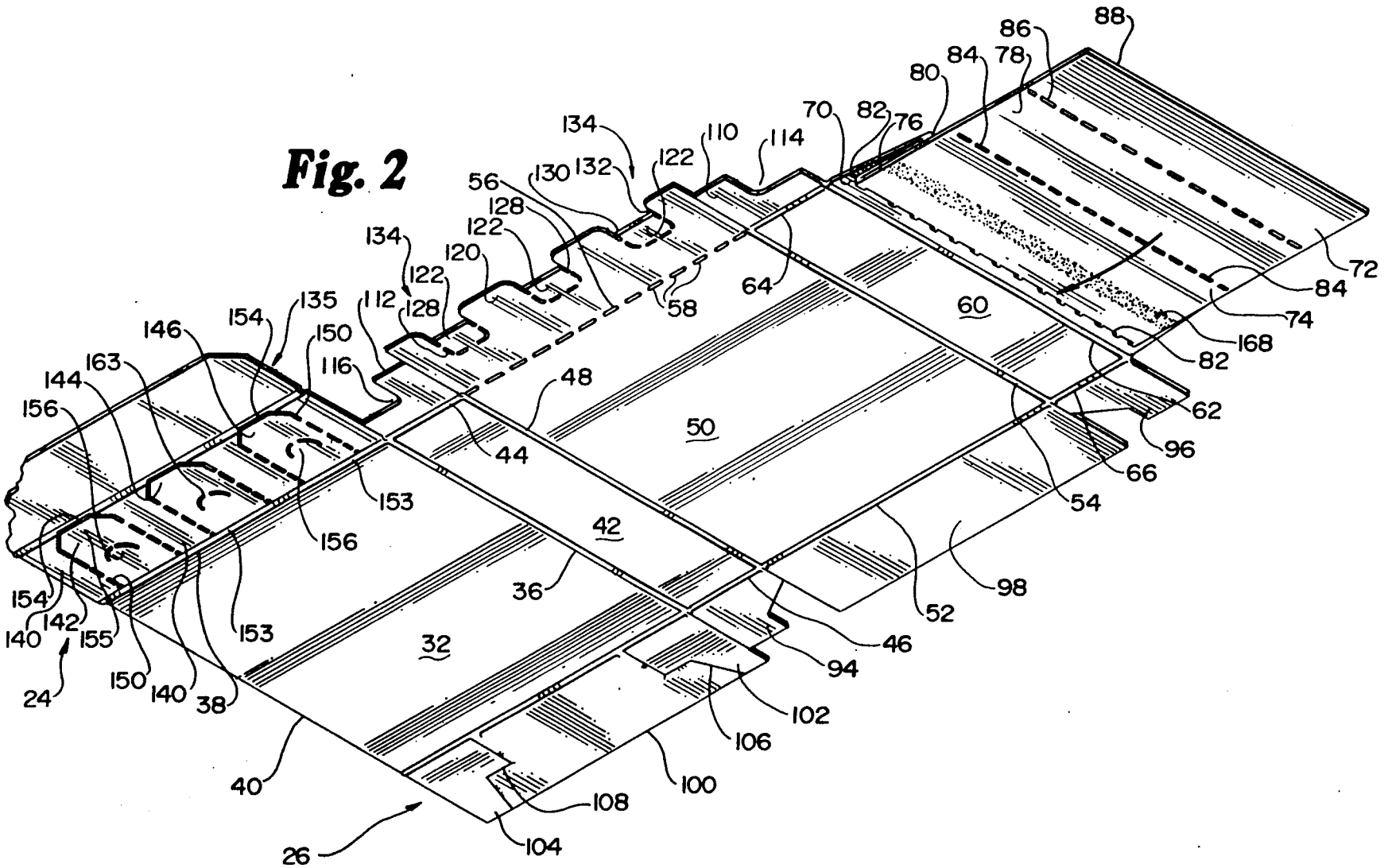
FIG. 2 is a perspective view of the blank depicting an initial step in the erection of the carton of the present invention.

FIGS. 2–5 depict the folding erection sequence of the carton 20 formed from the blank 30. First, 180 degree folds are made at fold lines 80 (a reverse fold) and 82, whereby the middle cell side wall panel 76 overlies cell front panel 70. As depicted in FIG. 2, a glue area 168 may be provided on cell wall rear panel 74 or, alternatively, an adhesive may be applied as depicted in FIG. 2 in a straight-line gluing application after the initial fold is made.

Figure 3:
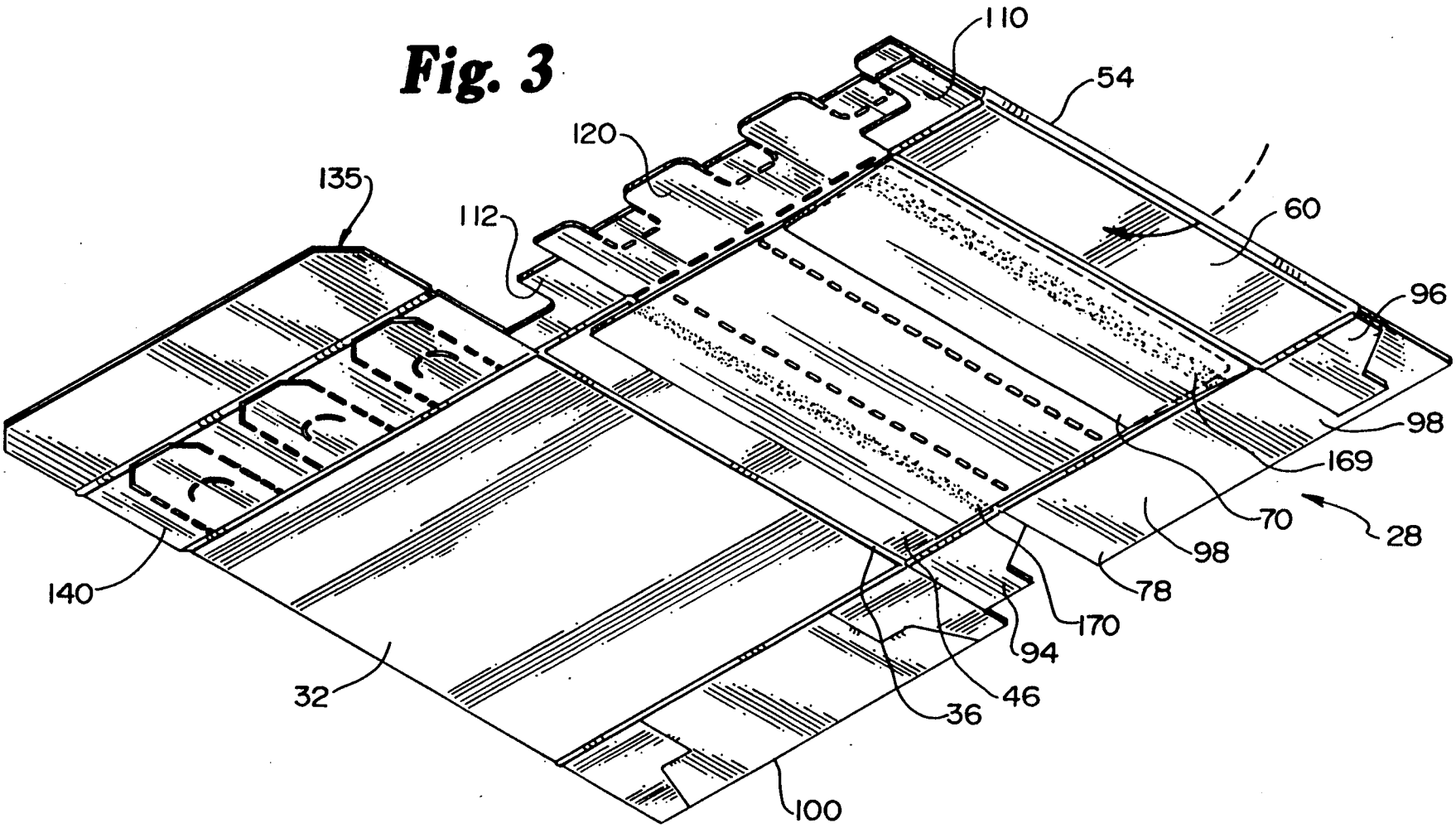
FIG. 3 is a perspective view depicting the next step in the erection sequence.

FIG. 3 depicts the second step in the erection sequence of the carton 20. Specifically, the entire interior cell structure 28 and carton side wall panel 60 are folded along fold line 54 to overlie the rear wall panel 50. As depicted in FIG. 3, glue areas 169, 170 may be provided on the cell wall front panels 72 and 70, or alternatively, adhesive may be applied as depicted in FIG. 3 after the second fold is made.

Figure 4:
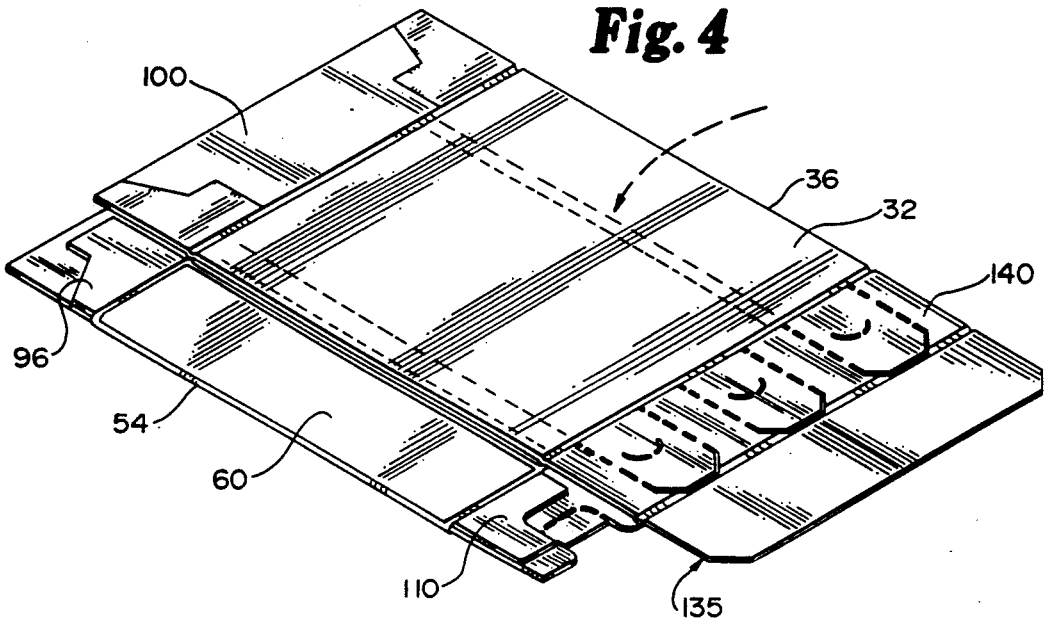
FIG. 4 is a perpective view of another step in the erection sequence.

FIG. 4 depicts a subsequent step in the erection sequence . Specifically, the front wall panel 32, and the top and bottom end closure flaps 153, 100 connected thereto, are folded along fold line 36 into overlying relationship with the remainder of the carton blank 30. The previously applied glue may then be activated or, if it is a contact type adhesive, the carton 20 will be fixed in the alignment and condition depicted in FIG. 4.

Figure 5:
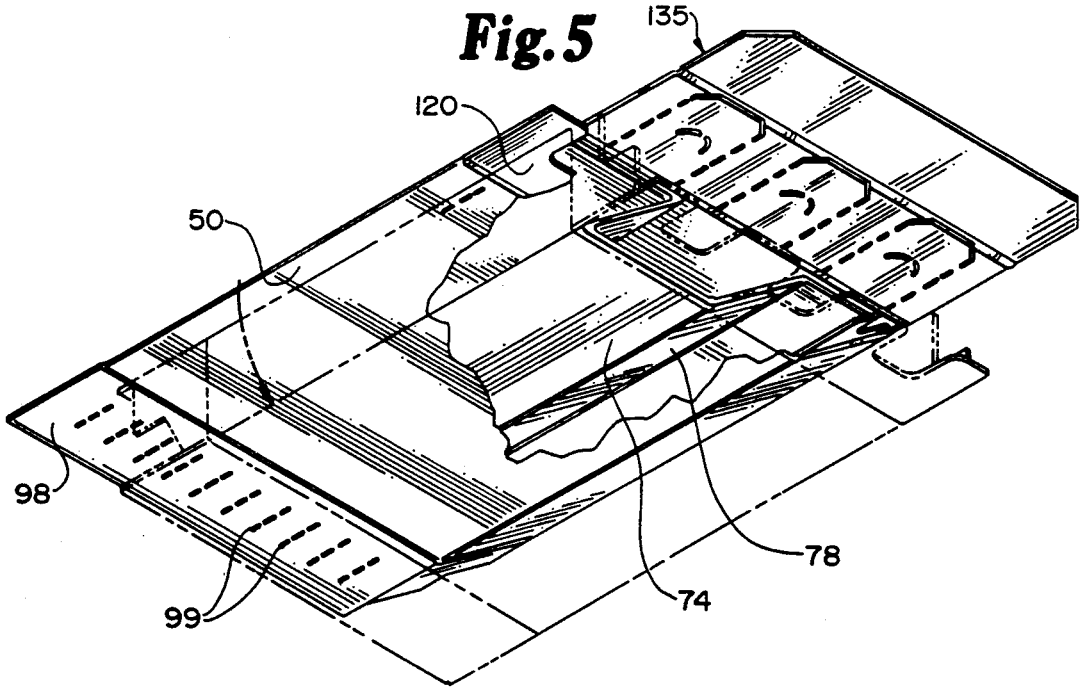
FIG. 5 is perspective view depicting a further step in the erection sequence.

The natural resiliency of the material forming the carton will cause the partially erected carton 20 to move into the condition depicted in phantom in FIG. 5. Specifically, the adhesive contact between the inside of the front wall panel 32 and the interior cell structure panels 70, 72 together with unfolding tendencies at 180 degree fold lines will cause the interior cell structure cell side walls 76, 78 to begin to assume a generally perpendicular position with respect to the front and rear carton wall panels 32, 50, respectively.

Figure 6:
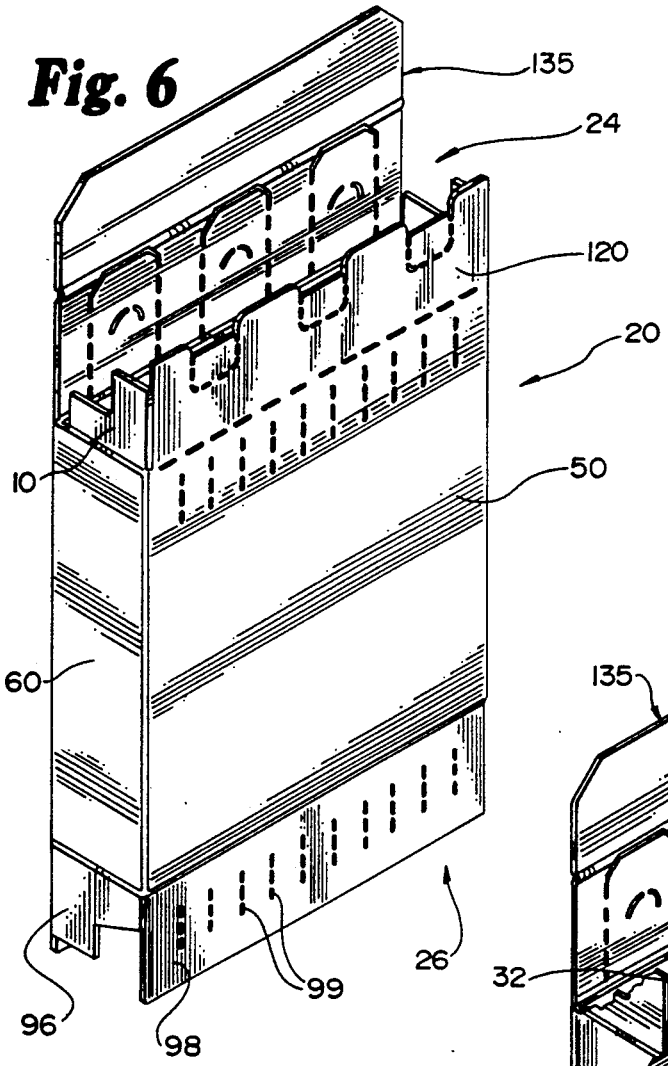
FIG. 6 is a perspective view depicting the carton erected and in a condition to be filled and sealed.

FIG. 6 depicts the configuration of the carton 20 upon full erection when all of the various panels identified and enumerated in FIG. 1 are either in parallel or perpendicular alignment with respect to one another. Specifially, the walls defining the sides of the carton 20, side walls 42, 60, are spaced from and parallel to the interior cell side walls 76, 78. FIG. 13 is provided to depict the interior cell structure 28 when the carton 20 is in the erected condition shown in FIG. 6. It will be appreciated that with a simple, straight line application of adhesive to the surfaces of front cell wall panels 72, 70 and rear cell wall panel 74, the carton 20 is completely glued with the exception of the top and bottom end closures.

Figure 7:
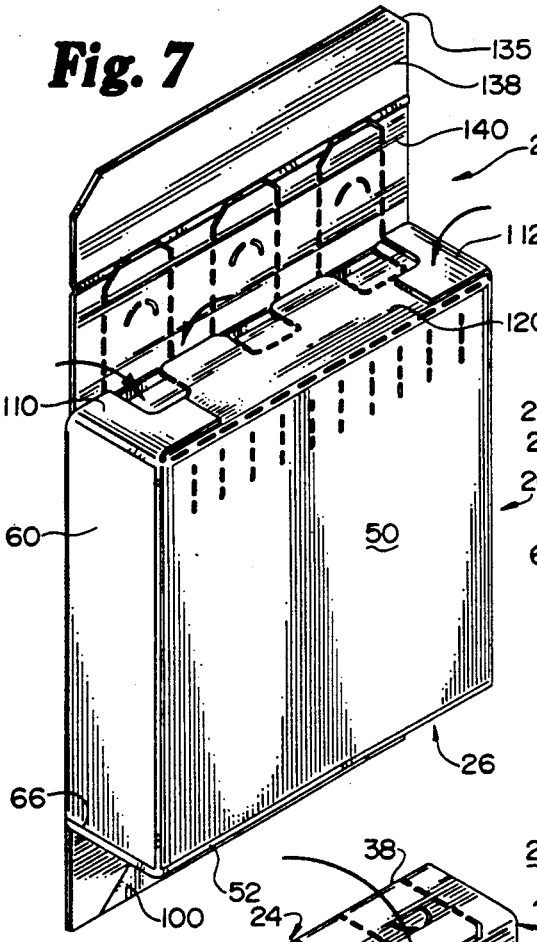
FIG. 7 is a perspective view of the carton of the present invention depicting the carton partially closed.

FIGS. 7 and 8 depict the closure sequence for the top and bottom ends 24, 26 of the carton 20. With regard to the bottom end structure 26, the major inside flap 98 is folded inwarldy about fold line 52. The minor inside closure flaps 94, 96 are folded along lines 46, 66 into overlying relationship with the major inside end closure flap 98. Finally, the major outside bottom end closure flap 100 is folded inwardly to overlie the other, previously-folded bottom end closure flaps. As depicted in FIG. 5, the inside bottom end closure flap 98 may be provided with adhesive score lines 99 and adhesive may be applied thereto at any time during the manufacturing, gluing or erection sequence.

With regard to the closure of the top end structure 24 of the carton 20, the major inside top end closure flap 120 is folded inwardly as shown in FIG. 7. Next, the two minor closure flaps 110, 112 are folded into overlying relationship with the inside top end closure flap 120. Finally, the major outside top end closure flap 135 is folded inwardly about fold line 38, whereby the opening panel 140 closely overlies the inside top end closure flap 120. The glue panel 138 is brought into contact with and affixed to the rear wall panel 50. At this point in the manufacture, gluing and erection sequence the carton will appear as depicted in FIG. 8, having been erected, partially closed, filled with product and sealed.

Figure 9:
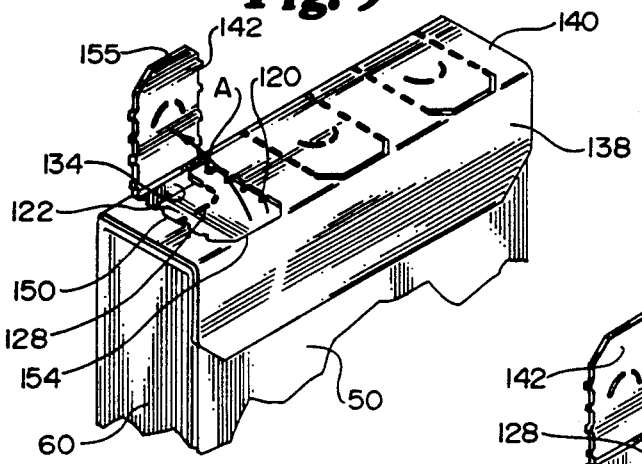
FIG. 9 is a fragmentary perspective view of the carton depicting one of the cover tabs partially torn open.
Figure 10:
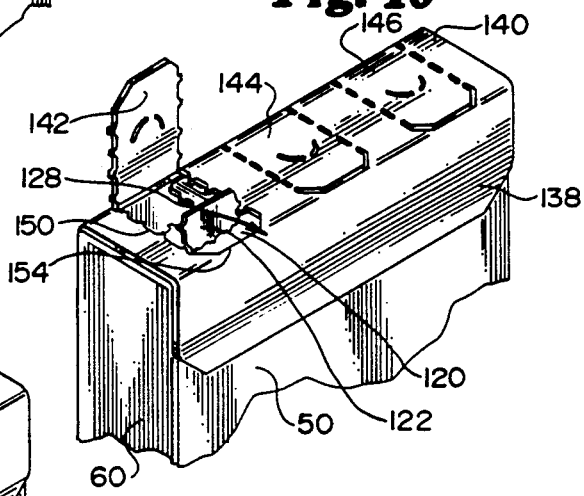
FIG. 10 is a fragmentary perspective view of the carton, similar to FIG. 9, depicting the dispensing opening completely opened by removal of an access tab.
Figure 11:
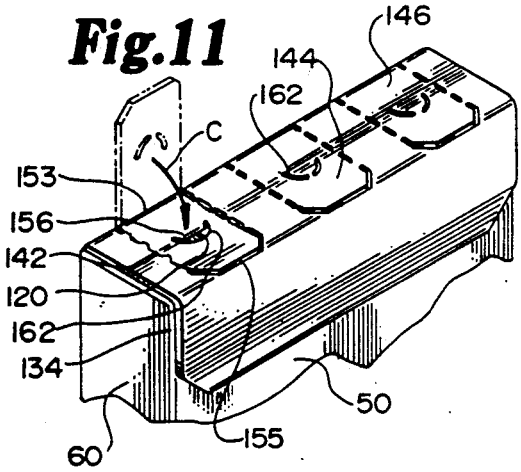
FIG. 11 is a fragmentary perspective view of the carton, similar to FIG. 10, depicting the dispensing opening reclosed.

FIGS. 9, 10 and 11 depict the opening and reclosing of the carton 20 of the present invention. Specifically, in FIG. 9, one of the cover tabs (tab 142) has been rotated upwardly by applying force along arrow A, causing tearing along the line of weakness 150 defining the cover tab 142. This can be done in a single upward motion and a consumer, even a child, may easily grasp the finger lip 155 of the cover tab 142 at the tab incision 154 to facilitate the opening. Once the cover tab 142 is in the condition depicted in FIG. 9, the access tab 122 associated with cover tab 142 may be grasped at the relieved area 134 and torn free from the major inside closure flap 120 to gain access to the product contained in the carton 20.

FIG. 11 depicts the reclosing of the carton 20. The previously opened lift away cover tab 142 simply is folded downwardly about the hinge area 153 until it comes into contact with or is closely adjacent to the major inside top end closure flap 120. Continued pressure directed toward the carton interior along arrow C will cause the semi-circular edge of the lock tab 156 to deflect under the edge of the opening created in the major inside top end closure flap 120 by the removal of the access tab 122. The semi-circular edge of the lock tab 156 defined by the incision 162 will lodge under the edge of the opening at the bottom of U-shaped line of weakness 128, securing the cover tab 142 in close contact with the outside surface of the inside top end closure flap 120. Reopening is convenient and easy because the lift away cover tab 142 may be grasped easily at the finger lip 155 formed by the tab incision 154 and because the resilient material from which the carton 20 is made permits the release of the lock tab 156 from under the edge of the opening created by the removal of the access tab 122.

While only one of the lift away cover tabs 142, 144, 146 associated with one of the carton interior cells is depicted as being opened in FIGS. 9–11, it should be appreciated that one or more of the carton interior cells in cell structure 28 may be opened or closed simultaneously using the cover tabs 142, 144, 146 and associated lock tabs 156.

FIGS. 12–17 depict an alternative embodiment of the present invention. With the exception of the top end 24 of the carton 20, as will be explained below, the alternative embodiment is substantially similar to the embodiment formed from the blank shown in FIG. 1 and, therefore, is substantially commonly numbered. The structures varying from the previously-described embodiment but having a corresponding reference number in the previously-described embodiment are indicated by corresponding numbers with a "2" in the hundreds place, such as 220 instead of 120.

Figure 12:
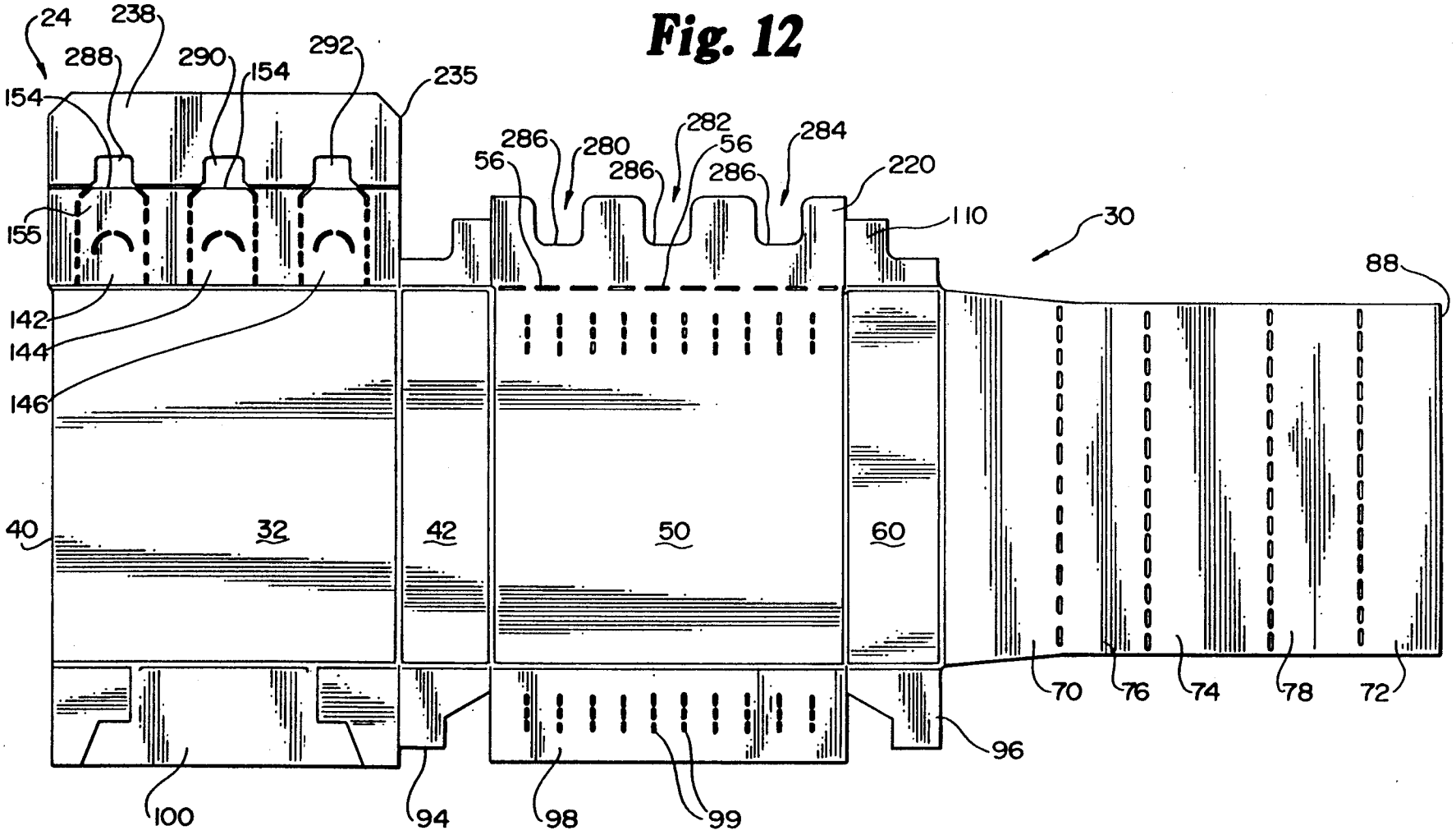
FIG. 12 is a top plan view of the inside surface of the blank from which an alternative embodiment of the carton of the present invention may be formed, and shows the die profile thereof.

With specific reference to the top end 24 of the carton 20, as depicted in FIG. 12, the major inside top end closure 220 is provided with a plurality of identations or product access openings 280, 282 and 284. The indentations 280, 282, 284 extend inwardly toward the generally central region of the flap 220 from the free edge thereof toward fold line 56. The indentations 280, 282, 284 are substantially equally spaced along the length of the flap 220 and have an innermost or base portion defined at edge 286.

The major outside top end closure flap 235 of the alternative embodiment depicted in FIG. 12 is provided with a plurality of stripped out notches or windows 288, 290, 292 formed by the removal of portions of the glue panel 238. Part of the perimeter of the windows 288, 290, 292 is formed by the signal cut 154 forming the finger lip 155 of the lift away cover tab 142, 144, 146.

Figure 14:
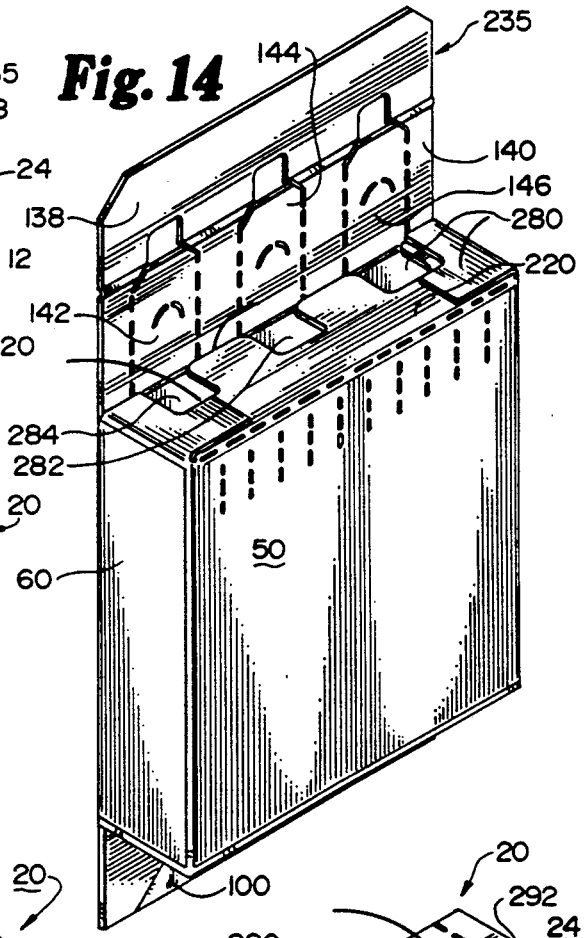
FIG. 14 is a perspective view of the alternative embodiment of FIG. 12 partially sealed.
Figure 15:
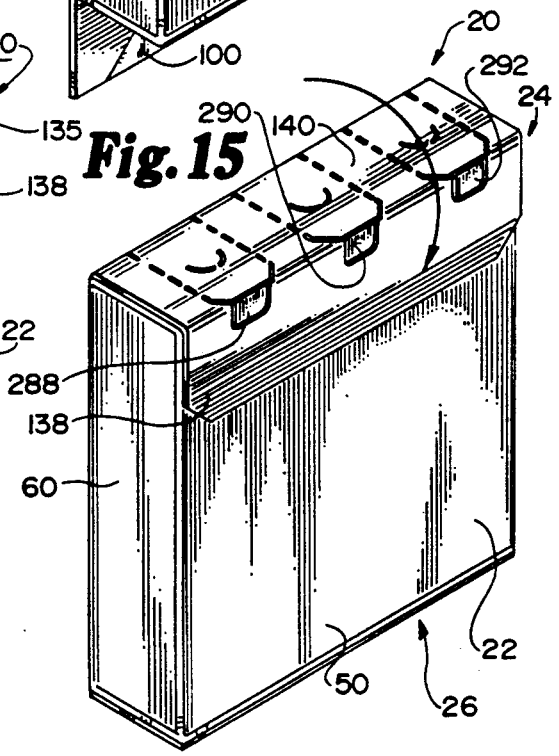
FIG. 15 is a perspective view of the alternative embodiment of FIG. 12 depicting the carton sealed.

As shown in FIGS. 14 and 15, the closure or sealing sequence of the alternative embodiment is substantially similar to that of the embodiment of the present invention depicted in FIGS. 7 and 8.

Figure 16:
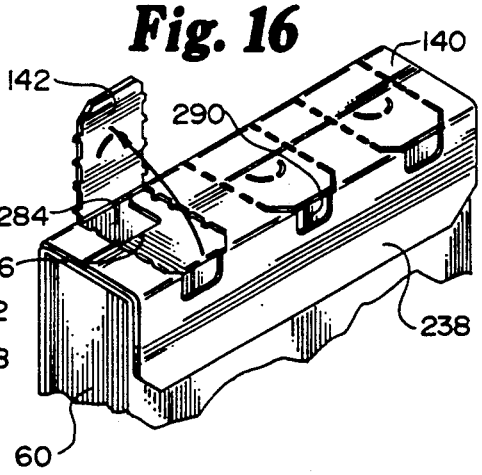
FIG. 16 is a fragmentary perspective view of the alternative embodiment of FIG. 12, similar to FIG. 10 in that it depicts a dispensing opening completely opened.
Figure 17:
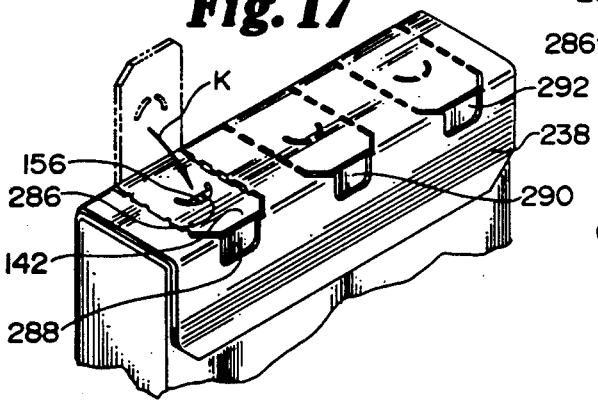
FIG. 17 is a fragmentary perspective view of the alternative embodiment of FIG. 12, similar to FIG. 11 in that it shows the dispensing opening reclosed.

Likewise, the opening and reclosing manipulation of the top end structure 24 of carton 20 of the alternative embodiment depicted in FIGS. 16 and 17 is substantially similar to that depicted in FIGS. 19–11. However, it should be appreciated that the windows 288, 290 and 292 facilitate the opening of the carton 20. It should also be appreciated that once a cover tab 142 is torn upwardly, as shown in FIG. 16, immediate access may be had to product contained in the carton 20 through the opening formed by the indentation 280 (or 282, 284 for cover tabs 144, 146). Reclosing the carton 20 is substantially the same as the procedure depicted in FIG. 11. That is, the lock tab 156 is deflected by downward pressure along arrow K until it snaps into place under the edge 286, thereby holding the cover tab 142 in place adjacent the major inside closure flap 220.

The present invention could be changed by modifying the shape of the windows 288, 290, 292 or the shape of the lift away cover tabs 142, 144, 146. Also, the hinge area 153 for each of the cover tabs 142, 144, 146 could be located in the interior of opening panel 140 rather than at an edge. Additionally, any number of internal cells could be provided with corresponding number of access openings in the top end closure 24 of the carton 20. Various cross-sectional configurations of the carton could be made and, of course, the carton may be provided with indicia or overwrapping as deemed appropriate.

Although the description of the preferred and an alternative embodiment has been presented, it is contemplated that various changes, including those mentioned above, could be made without deviating from the spirit of the present invention. It is desired, therefore, that the present invention be considered in all respects as illustrative, not restrictive, and that reference be made to the appended claims rather than to the foregoing description to indicate the scope of the invention.

What is claimed and desired to be protected by Letters Patent is:

1. A carton having a multi-layered dispensing end closure, said carton having front and rear walls, side walls connected to and extending between said front and rear walls, a closed bottom end and a top dispensing end, said dispensing end closure comprising a plurality of panels in parallel, planar relationship including:

an inside major panel having opposed, generally parallel front and rear edges and opposed, generally parallel side edges, said panel foldably connected to said carton along one of the front and rear edges of said panel, the other of the front and rear edges of said panel having one or more relieved areas;

an outside major panel comprising an opening panel and a glue panel foldably connected each other at a fold line, said opening panel being foldably connected to said front wall and having one or more cover means rotatably coupled to said opening panel for selectively covering or exposing one of said relieved areas;

two opposed minor side flaps, one of said side flaps foldably connected to each of said walls; and locking means located in the plane of and generally in the center of each of said cover means or deflecting towards the carton interior and securing each of said cover means to one of said relieved areas of said inside major panel when said cover means is reclosed.

2. The carton according to claim 1, wherein said locking means comprises a semi-circular region of said cover means, said region defined by a semi-circular cut in said cover means, said region foldably deflectable out of the plane of the cover means along a diameter extending between ends of said semi-circular cut.

3. A reclosable, dispensing opening structure for a carton made of thin, flexible material, comprising:

an inside major panel having a first edge and being attached to the carton at said first edge, said inside major panel having a free edge opposite said first edge and one or more access openings providing access to an interior of the carton;

an outside major panel attached to the carton, said outside major panel having one or more cover tabs, each defined by a weakened line in said outside major panel that intersects with a hinge line and forms a closed plane figure therewith, each said cover tabe overlying at least a portion of one of said one or more access openings and being rotatable out of the plane of the outside major panel by tearing along said weakened line and rotation around said hinge line; and lock tab means associated with each said cover tab and located within the closed plane figure defining said cover tab for reclosable locking of the cover tab over its associated access opening, each said lock tab means being deflectable out of the plane of its associated cover tab and towards the carton interior to frictionally engage the free edge of the inside major panel within the associated access opening when the associated cover tab is rotated back into the plane of the inside major panel.

4. The opening structure as recited in claim 3 wherein the inside major panel is attached to the carton along a first fold line defining a first edge of said inside major panel and the free edge is opposite said first edge of said inside major panel.

5. The opening structure as recited in claim 4 wherein the outside major panel is attached to the carton along a second fold line and the hinge line for each cover tab substantially coincides with the second fold line.

6. The opening structure as recited in claim 5 wherein the second fold line is parallel and opposed to the first fold line.

7. The opening structure as recited in claim 5 wherein the carton is a generally rectangular box carton and the opening structure is at the top end closure of the carton and the first and second fold lines are located at the top edges of a pair of opposed panels of said rectangular box carton.

8. The opening structure as recited in claim 3 wherein each lock tab means is formed by a semi-circular cut through the associated cover tab.

9. The opening structure as recited in claim 8 wherein each lock tab further comprises an uncut segment within the semicircular cut.

10. The opening of claim 3 wherein each access opening is formed by a relieved area along the free edge of said inside major panel.

11. The opening structure of claim 3 wherein each access opening is at least partially closed by a removable access tab in said inside major panel.

12. The opening structure of claim 3 wherein each access opening is formed by a removalbe access tab extending from the free edge of said inside major panel.

13. A reclosable, dispensing opening structure for a carton made of thin, flexible material, comprising:

an inside major panel having a first edge and being attached to the carton at said first edge, said inside major panel having a free edge opposite said first edge and one or more access openings providing access to an interior of the carton;

an outside major panel attached to the carton, said outside major panel having one or more cover tabs, each defined by a weakened line in said outside major panel that intersects with a hinge line and forms a closed plane figure therewith, each said cover tab overlying at least a portion of one of said one or more access openings and being rotatable out of the plane of the outside major panel by tearing along said weakened line and rotation around said hinge line; and lock tab means associated with each said cover tab and located within the closed plane figure defining said cover tab for reclosable locking of the cover tab over its associated access opening, each said lock tab means being formed by a semicircular cut through the associated cover tab and comprising an uncut segment within the semicircular cut for tamper evidence, each said lock tab means being deflectable out of the plane of its associated cover tab to frictionally engage the free edge of the inside major panel when the associated cover tab is rotated back into the plane of the inside major panel.

14. A blank for forming a carton generally in the form of a rectangular box and having a reclosable, dispensing opening structure, said carton made of thin, flexible material and comprising:

a. first main wall panel, a first side panel, a second main wall panel and a second side panel consecutively joined together at substantially parallel first, second and third wall panel fold lines;

a bottom end structure comprising at least two bottom end closure flaps, one being connected to each of said first and second main wall panels at a bottom end closure fold line; and a top end closure panel structure incorporating said opening structure and comprising:

an inside major panel attached to one of said first and second main wall panels along a first top end closure fold line defining a first edge of said inside major panel, said inside major panel having a free edge opposite said first edge and one or more access openings providing access to an interior of the carton;

an outside major panel attached to the other of said first and second main wall panels along a second fold line defining a first edge of said outside major panel, said outside major panel having one or more cover tabs, each defined by a weakened line in said outside major panel that intersects with a hinge line and forms a closed plane figure therewith, each said cover tab being rotatable out of the plane of the outside major panel by tearing along said weakened line and rotation around said hinge line; and lock tab means associated with each said cover tab and located within the closed plane figure defining said cover tab for reclosable locking of the cover tab over its associated access opening, each said lock tab being deflectable out of the plane of its associated cover tab to frictionally engage the free edge of the inside major panel when the top end closure panel structure is erected and the associated cover tab is rotated back into the plane of the inside major panel.

15. The blank according to claim 14, wherein each of said one or more access openings is adjacent said free edge and extends inwardly toward the generally central region of said panel.

16. The blank according to claim 14, wherein each of said one or more access openings is openably closed by a removable inside access tab defined by a generally U-shaped line of weakness having two ends, said ends adjacent said free edge, said access tab made from the same material of said blank and generally coplanar with said inside major panel before removal from each of said one or more said access openings.

17. The blank according to claim 14, wherein said outside major panel includes a fold score line generally parallel to said second fold line, said fold score line splitting said major panel into a gluing panel portion and an opening panel portion, each of said one or more cover tabs being in said opening panel portion and each of said one or more tabs having a lip, said lip being generally collinear with said fold score line.

18. The blank according to claim 14, wherein said lock tab means comprises:

a generally central region of said associated cover tab, said region adjacent and defined by a cut line, said region resiliently deflectable out of plane of said associated cover tab.

19. A blank for forming a carton generally in the form of a rectangular box and having a reclosable, dispensing opening structure, said carton made of thin, flexible material and comprising:

a first main wall panel, a first side panel, a second main wall panel and a second side panel consecutively joined together at substantially parallel first, second and third wall panel fold lines;

a bottom end structure comprising at least two bottom end closure flaps, one being connected to each of said first and second main wall panels at a bottom end closure fold line; and a top end closure panel structure incorporating said opening structure and comprising:

an inside major panel attached to one of said first and second main wall panels along a first top end closure fold line defining a first edge of said inside major panel, said inside major panel having a free edge opposite said first edge and one or more access openings providing access to an interior of the carton wherein each of said one or more access openings is openably closed by a removable inside access tab defined by a generally U-shaped line of weakness having two ends, said ends adjacent said free edge, said access tab made from the same material of said blank and generally coplanar with said inside major panel before removal from each of said one or more access openings;

an outside major panel attached to the other of said first and second main wall panels along a second fold line defining a first edge of said outside major panel, said outside major panel having one or more cover tabs, each defined by a weakened line in said outside major panel that intersects with a hinge line and forms a closed plane figure therewith, each said cover tab being rotatable out of the plane of the outside major panel by tearing along said weakened line and rotation around said hinge line; and lock tab means associated with each said cover tab and located within the closed plane figure defining said cover tab for reclosable locking of the cover tab over its associated access opening, each said lock tab being deflectable out of the plane of its associated cover tab to frictionally engage the free edge of the inside major panel when the top end closure panel structure is erected and the associated cover tab is rotated back into the plane of the inside major panel.

20. A blank for forming a carton generally in the form of a rectangular box and having a reclosable, dispensing opening structure, said carton made of thin, flexible material and comprising:

a first main wall panel, a first side panel, a second main wall panel and a second side panel consecutively joined together at substantially parallel first, second and third wall panel fold lines;

a bottom end structure comprising at least two bottom end closure flaps, one being connected to each of said first and second main wall panels at a bottom end closure fold line; and a top end closure panel structure incorporating said opening structure and comprising:

an inside major panel attached to one of said first and second main wall panels along a first top end closure fold line defining a first edge of said inside major panel, said inside major panel having a free edge opposite said first edge and one or more access openings providing access to an interior of the carton;

an outside major panel attached to the other of said first and second main wall panels along a second fold line defining a first edge of said outside major panel, said outside major panel having one or more cover tabs, each defined by a weakened line in said outside major panel that intersects with a hinge line and forms a closed plane figure therewith, each said cover tab being rotatable out of the plane of the outside major panel by tearing along said weakened line and rotation around said hinge line; and lock tab means associated with each said cover tab and located within the closed plane figure defining said cover tab for reclosable locking of the cover tab over its associated access opening, each said lock tab comprising a generally central region of said associated cover tab, said region adjacent and defined by a cut line and being resiliently deflectable out of the plane of its associated cover tab to frictionally engage the free edge of the inside major panel when the top end closure panel structure is erected and the associated cover tab is rotated back into the plane of the inside major panel wherein said cut line is generally semicircular and includes at least one nick means for providing evidence of attempted tampering.

* * * * *